US008720736B2

(12) United States Patent
Boland

(10) Patent No.: US 8,720,736 B2
(45) Date of Patent: May 13, 2014

(54) STORAGE BOX

(75) Inventor: Brian Timothy Boland, Thirroul (AU)

(73) Assignee: Helen Jane Boland, Thirroul (AU)

( * ) Notice: Subject to any disclaimer, the term of this patent is extended or adjusted under 35 U.S.C. 154(b) by 1917 days.

(21) Appl. No.: 11/573,088

(22) PCT Filed: Aug. 1, 2005

(86) PCT No.: PCT/AU2005/001112

§ 371 (c)(1),
(2), (4) Date: Feb. 1, 2007

(87) PCT Pub. No.: WO2006/012674

PCT Pub. Date: Feb. 9, 2006

(65) Prior Publication Data

US 2008/0312054 A1 Dec. 18, 2008

(30) Foreign Application Priority Data

Aug. 2, 2004 (AU) ..... 2004904284

(51) Int. Cl.
*B65D 6/28* (2006.01)
*B65D 43/08* (2006.01)
*B65D 5/36* (2006.01)

(52) U.S. Cl.
USPC ..... 220/617; 229/125.26; 229/125.28; 229/117.02

(58) Field of Classification Search
CPC ..... B65D 5/685; B65D 5/68; B65D 5/248; B65D 5/14; B65D 5/36; B65D 5/326; B65D 5/12
USPC ..... 206/508, 425, 557, 459.5; 211/46, 45, 211/47, 48; 229/67.1, 67.2, 67.4, 122.27, 229/122.3, 125.26, 125.32, 117.02, 125.25, 229/125.28, 125.13; 493/102; 220/617, 220/529, 509, 508, 425
See application file for complete search history.

(56) References Cited

U.S. PATENT DOCUMENTS 2,398,405 A * 4/1946 Brooks ..... 229/5.5
2,801,039 A 7/1957 Arneson (Continued)

FOREIGN PATENT DOCUMENTS

GB 2 100 229 12/1982
GB 2 318 569 4/1998

OTHER PUBLICATIONS

International Preliminary Report on Patentability for corresponding PCT application PCT/AU2005/001112, Nov. 13, 2006.

*Primary Examiner* — Anthony Stashick
*Assistant Examiner* — Kaushikkumar Desai
(74) *Attorney, Agent, or Firm* — Scott A. Felder; Wiley Rein LLP

(57) ABSTRACT

A stackable and collapsible storage box (100) comprising a foldable wrapper (10) having side wall and end wall panels which are releasably retained within a peripheral channel (30*a*) on a separate base portion (30). The wall panels have lower extension portions (11, 12) that are folded upwardly to provide a double thickness and these lower extension portions have an upper edge (12*a*) or apertures (37) that engage with short protrusions (33) formed on an inner wall (32) of the channel to retain the panels. The end wall panels have upper first and second extensions portions (14*a*, 16) that are respectively folded inwardly and upwardly to provide a support edge (16*a*) to support hangers for hang files. The support edge can be strengthened with a channel section (19). The box can have a lid (50) has a ridge (53) to compliment channel (36) on the base portion to allow stacking.

22 Claims, 11 Drawing Sheets

(56) References Cited

U.S. PATENT DOCUMENTS

| | | | | | |
|---|---|---|---|---|---|
| 2,954,914 | A | * | 10/1960 | Herlihy | 229/117.17 |
| 3,157,343 | A | * | 11/1964 | Kendall | 229/115 |
| 3,161,345 | A | | 12/1964 | McLeod | |
| 3,223,278 | A | * | 12/1965 | Allen | 220/320 |
| 3,321,855 | A | * | 5/1967 | Phelps | 40/651 |
| 3,645,437 | A | * | 2/1972 | Giebel et al. | 206/425 |
| 3,650,055 | A | * | 3/1972 | Bult, III | 40/506 |
| 3,913,774 | A | | 10/1975 | Vajtay | |
| 3,938,870 | A | * | 2/1976 | Guest et al. | 312/184 |
| 4,266,715 | A | * | 5/1981 | Garrison | 206/425 |
| 4,287,997 | A | * | 9/1981 | Rolfe et al. | 220/1.5 |
| 4,958,728 | A | * | 9/1990 | Effendi | 206/425 |
| 4,971,201 | A | * | 11/1990 | Sathre | 206/509 |
| 5,033,669 | A | * | 7/1991 | Federico | 229/198.1 |
| 5,265,797 | A | * | 11/1993 | Velge et al. | 229/125.26 |
| 5,295,632 | A | * | 3/1994 | Zink et al. | 229/198 |
| 5,398,868 | A | * | 3/1995 | Densen | 229/125.08 |
| 5,474,196 | A | * | 12/1995 | Fausel et al. | 220/4.28 |
| 5,494,161 | A | * | 2/1996 | Herbst | 206/425 |
| 5,538,178 | A | * | 7/1996 | Zink et al. | 229/117.01 |
| 5,699,959 | A | * | 12/1997 | Huspeka et al. | 229/125.26 |
| 5,816,437 | A | | 10/1998 | Lin | |
| 5,842,570 | A | * | 12/1998 | Turnbull | 206/425 |
| 5,960,708 | A | * | 10/1999 | DeTemple et al. | 99/472 |
| 5,992,073 | A | * | 11/1999 | Wolpa | 40/651 |
| 6,299,059 | B1 | * | 10/2001 | Bernstein | 229/115 |
| 6,305,601 | B1 | * | 10/2001 | Bazany et al. | 229/199 |
| 6,547,127 | B2 | * | 4/2003 | Bradford et al. | 229/199 |
| 6,564,993 | B1 | * | 5/2003 | Wassink | 229/199 |
| 6,619,540 | B1 | * | 9/2003 | Bazany | 229/199 |
| 6,811,041 | B1 | * | 11/2004 | Juliano | 211/46 |
| 6,959,507 | B2 | * | 11/2005 | Bazany et al. | 40/312 |
| 2003/0221987 | A1 | * | 12/2003 | Trude | 206/508 |

* cited by examiner

STORAGE BOX

RELATED APPLICATIONS

This application is the U.S. National Phase of PCT/AU2005/001112 filed Aug. 1, 2005 and claims priority to Australian Provisional Patent Application No. 2004904284 filed Aug. 2, 2004, which are hereby incorporated herein by reference in their entirety.

The Present Invention Relates to Stackable Boxes suitable for use as general storage boxes and/or as archive boxes for documents and hanging files, and which are manufactured in a flat pack form to be easily assembled by the consumer.

BACKGROUND

Market Researchers know that the average American consumer currently has some twenty thousand individual possessions in their homes and say that this number is growing yearly. A good percentage of these possessions are not often used and are stored indefinitely.

Companies generally wish to maintain archived copies of past transactions. It is also a requirement in many jurisdictions that matters relating to a company's transactions be retained for a number of years, causing a large accumulation of files and papers, which must then be retrievably archived.

Additionally, an increasing number of people maintain an office at their home or are establishing small businesses. Consequently there is an expanding need for relatively inexpensive general storage and files storage boxes that are sturdy and stack easily to conserve floor space in storage areas of the home and office.

Low cost storage and or hanging file boxes that are flat packed and assembled by the consumer are commercially available. These available forms are die cut from sheet fibreboard with fold creases allowing them to be folded into a box structure having four side walls, a bottom formed by interlocking flaps projecting at right angles from the bottom of the side walls, and have an open top. The two opposite edges of the top may be so spaced as to act as rails for the support of standard hanging files. Generally a separate folded fibreboard lid is also provided with these common forms.

In a variant of this form, disclosed by U.S. Pat. No. 5,494,161, edges for support of hanging files within the box may be formed by a pair of opposite fibreboard flaps that extend vertically from the bottom of the box to a distance short of the top edge of the box.

A disadvantage of these types of storage boxes, is that their bottoms tend to fail and open when loaded. Also they do not stack well because they do not positively locate one on top of the other, and lack structural integrity to properly support the weight of superior boxes in a stack.

Additionally, any dampness on the floor of the storage area may result in damage to the contents and softening of the lower portion of the side walls of the bottom box leading to possible failure of the walls and collapse of the stack. Some manufacturers attempt to overcome the structural deficiencies of current forms by using heavier weight fibreboard and the inclusion of more flaps and or additional separate pieces of fibreboard to reinforce the sides and the bottom. However, such structural remedies are a poor use of a natural resource [wood fibre] and significantly increase the cost to the consumer for little net product improvement.

It is an object of the present invention to address or ameliorate some of the above disadvantages.

The term "comprising" (and grammatical variations thereof) is used in this specification in the inclusive sense of "having" or "including", and not in the exclusive sense of "consisting only of".

BRIEF DESCRIPTION OF THE INVENTION

Accordingly, in one broad form of the invention there is provided a storage box primarily for home or office use comprising at least one side wall panel; said storage box further comprising a separate base portion; said at least one side wall panel provided with attachment elements adapted for releasable retention of lower portions of said panels within said base portion.

Preferably said at least one side wall panel comprises opposing side wall panels and opposing end wall panels.

Preferably said opposing side wall panels and said opposing end wall panels are provided as a wrapper, said panels divided by preformed fold lines.

Preferably said storage box is provided as a flat pack prior to use.

Preferably said wrapper comprises die-cut substantially rigid material; said material provided with pre-formed folds.

Preferably said base portion comprises a substantially planar portion bounded by an upper peripheral channel.

Preferably said upper peripheral channel projects upwardly from said substantially planar portion; said channel comprising an outer vertical wall and an inner vertical wall, and wherein at least one of said outer wall and said inner wall is provided with protrusions adapted to releasably engage with said attachment elements of said side wall panels and said end wall panels.

Preferably said attachment elements comprise lower extension portions at each lower edge of said opposing side wall panels and said opposing end wall panels; said lower extension portions adapted to be folded upwardly so as to provide a lower double thickness portion along each said lower edge.

Preferably said attachment elements comprise a series of pre-punched holes in said lower extension portions of respective said side wall panels and said end wall panels.

Preferably said upper peripheral channel of said base portion is adapted to accept insertion of each said lower double thickness portions.

Preferably when each said double thickness portion is inserted into said peripheral channel of said base portion, an upper edge of each said lower extension portion is releasably retained by said protrusions.

Preferably when each said lower extension portion is inserted into said peripheral channel of said base portion, said pre-punched holes engage with corresponding said protrusions.

Preferably each of said side wall panels and said end wall panels are provided with an upper extension portion; each said upper extension portion adapted to be folded downwardly about respective upper edges of said side wall panels and said end wall panels to form an upper double thickness portion along each of said panels.

Preferably each said upper extension portion of said end wall panels comprises a first extension portion and a second extension portion; said first extension portion folded downwardly from said upper edge and said second extension portion folded upwardly to form a folded lower edge; said second extension portion thereby providing a supporting edge adjacent said upper edge of said end Wall panels, said supporting edge positioned below said upper edge of said end wall panels.

Preferably said second extension portion is provide with tabs disposed at outer ends of said portion; said tabs adapted to engage with holes in adjoining extension portions of each of said side wall panels; said tabs and said holes arranged se as to maintain said supporting edge in a predetermined position.

Preferably said supporting edge is provided with a length of channel section adapted to fit over said is supporting edge; said channel section acting to strengthen and protect said supporting edge from damage.

Preferably said predetermined position of each said supporting edge and said channel section at each said end wall panel is adapted to support hangers for hang files.

Preferably each of said end wall panel is provided with an aperture adapted for grasping by the hand of a user; an upper edge of said aperture coincident with said folded lower edge.

Preferably at least one of said end wall panels is provided with a label holder adapted for retention of an identifying label, said holder provided with projecting lugs adapted for insertion into, and retention in, pre-punched holes provided in said end wall panel.

Preferably said label holder comprises side members, an upper cross member and a lower cross member; said upper cross member provided with a cut-out portion forming a slot when said holder is assembled to said storage box.

Preferably said slot is adapted for insertion therethrough of a half folded standard sized sheet of paper.

Preferably said upper cross member is provided with an inwardly projecting lip; said lip adapted to engage an edge of said sheet of paper.

Preferably said storage box is provided with a lid portion; said lid portion comprising a substantially planar portion and a peripheral channel portion; said channel portion adapted for engagement with said upper edges of said side wall panels and said end wall panels.

Preferably said base portion is provided with a peripheral lower channel projecting downwardly from said planar portion.

Preferably said lid portion is provided with an upwardly projection peripheral ridge.

Preferably said peripheral lower channel of said base portion and said upwardly projecting peripheral ridge of said lid portion are adapted for engagement one with the other thereby locating a superior said storage box to a supporting said storage box in a stack of storage boxes.

Preferably said lid portion is provided with an opening section; said opening section comprising said substantially planar portion hingedly attached to one side element of said peripheral channel portion.

Preferably said side wall panels of said wrapper are provided with central vertical pre-formed folds; said folds adapted to folding said side wall panels for packaging; said wrapper when in a folded state for packaging nested within an inverted said lid portion; said lid portion engaged with an inverted said base portion.

Preferably said storage box is provided in a package; said package including:

(a) said wrapper,
(b) said base portion,
(c) said lid portion,
(d) a pair of said channel sections, and
(e) a label holder.

In a further broad form of the invention there is provided a method of erecting the storage box, said method including the steps of:

(a) removing components of said storage box from said package,
(b) fitting said at least one side wall panel to said base portion Preferably said method including the further steps of:

(a) arranging said wrapper into a box like configuration,
(b) folding said lower extension portions of said side walls and said end walls upwardly at said pre-formed folds,
(c) folding said upper extension portions of said side walls and said end walls downwardly,
(d) inserting said lower edges of said side walls and said end walls into said peripheral channel of said base portion,
(e) folding said second extension portions of said end walls upwardly to provide said supporting edges,
(f) fitting said supporting edges with said lengths of channel sections,
(g) fitting said lid portion to said upper edges.

In yet a further broad form of the invention there is provided a storage box as herein described and with reference to the accompanying drawings.

In yet a further broad form of the invention there is provided a storage receptacle comprising a one piece wall structure having four articulated walls which may be folded flat and opened out to form a rectangular prism section said articulated walls having retaining elements at the lower ends of each wall that may be inserted in a channel section at the periphery of an otherwise planar base panel to effect permanent interlocking of walls and base to form an open top box structure.

Preferably the interlocking of walls and base is effected by means of a short inwardly and upwardly facing return fold at the bottom of each wall panel that co acts with a channel section in the periphery of the base panel such that insertion of the short fold into the base channel causes the upper edge of the fold to become entrapped beneath the edge of a plurality of short inward projecting protrusions within the channel.

Preferably the interlocking of walls and base is effected by means of an inwardly facing fold having a plurality of holes therein that co acts with a channel section in the periphery of a base panel such that insertion of the fold into the base channel causes the lower edge of the holes to become entrapped beneath the edges of a plurality of short inward projecting protrusions within the channel.

Preferably opposite walls of the wall structure have articulated at their top edge a secondary panel that may be folded down within the box; said secondary panels have toward their midsection a transverse crease such that the lower portion of the fold may be folded back up upon the upper portion so that the edge of the secondary panel terminates at little short of the top edge of the wall and are so positioned to form two support walls for the placement of the notched ends of hanging files; the side edges of the support walls have a short tab that engage reciprocal slots in fold down flaps of adjacent side panels to retain the walls in location; the upper edges of the wall are fitted with channel section lengths to give additional beam strength and to protect the edge from damage by the notched ends of the hanging files.

Preferably said receptacle having a lid with a downward facing channel section at it's underside periphery such that the channel section releasably engages over the upper edges of the wall structure thereby to enhance structural integrity of said receptacle to increase the load bearing capacity of the walls when receptacles are stacked vertically and maintain walls substantially planar.

Preferably said receptacle having vertical stacking alignment features in the form of a short upstanding wall at the outer periphery of the lid and a reciprocal shallow channel to loosely accept said short upstanding wall.

Preferably said receptacle having a lid with a three sided frame element that fixedly attaches to three adjacent top edges of the wall structure; the middle frame element having a planar panel integrally hinged so as to form a pivotal lid.

Preferably the wall structure is made of fibre board or any material that supports creased fold lines.

Preferably any number of side walls and having the base and lid so shaped to accommodate the side walls.

Preferably said receptacle herein disclosed with reference to any one of the accompanying drawings.

BRIEF DESCRIPTION OF DRAWINGS

Embodiments of the present invention will now be described with reference to the accompanying drawings wherein.

DETAILED DESCRIPTION OF PREFERRED EMBODIMENTS

First Preferred Embodiment

Figure 4:
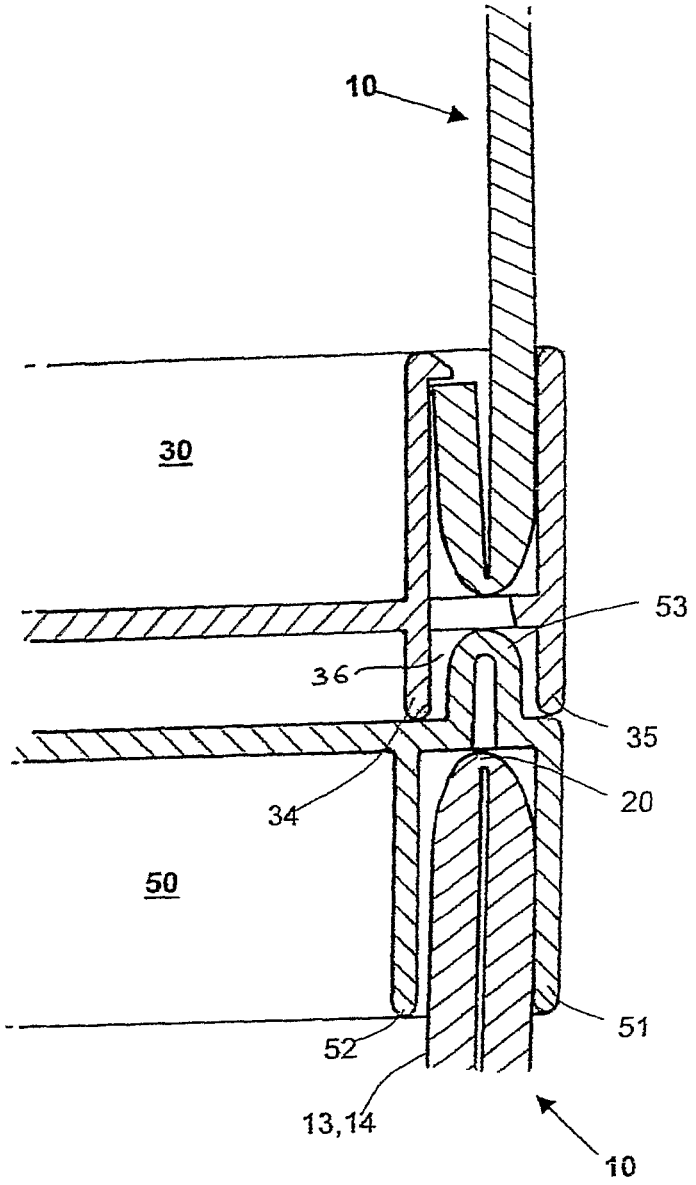
FIG. 4 shows a partial section view of a preferred alignment means for stacking the storage boxes of FIG. 1 one on top of another.
Figure 5:
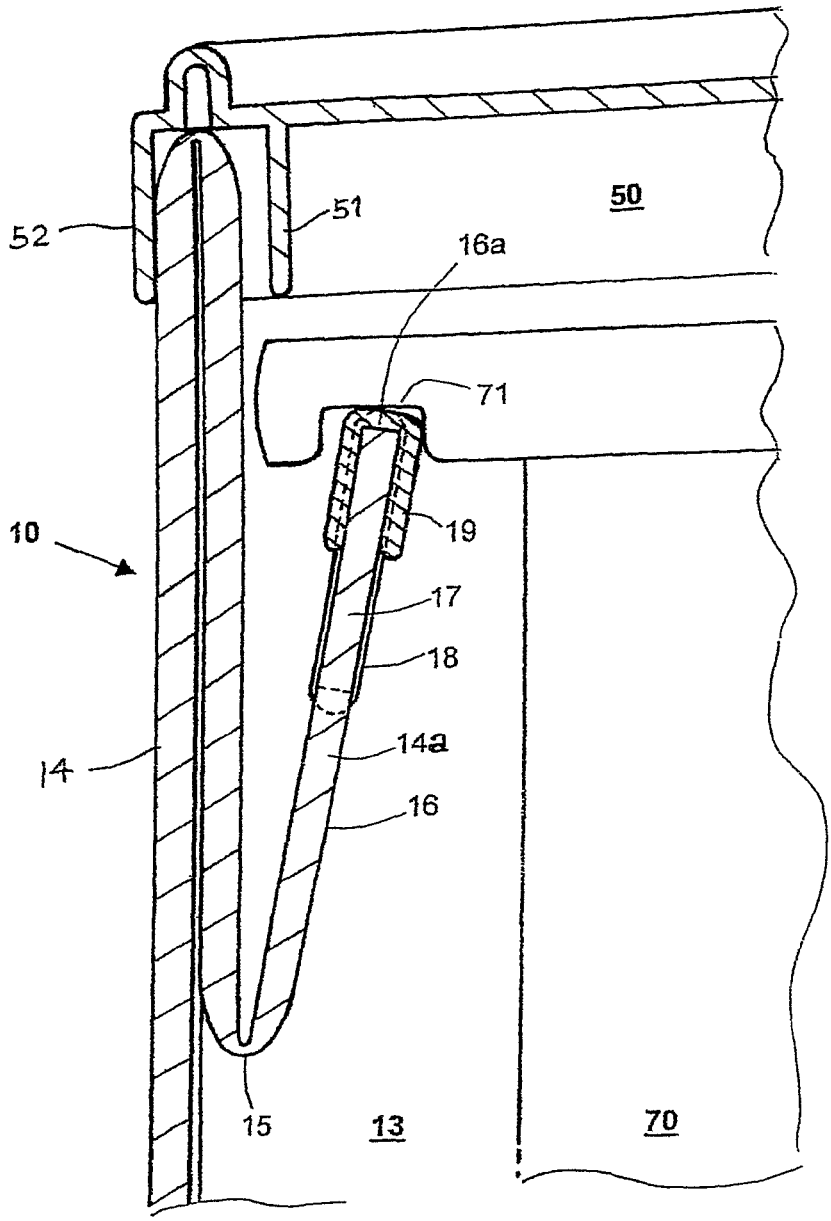
FIG. 5 shows a partial section view of one end of a preferred embodiment of a storage box wherein hanging files may be supported and contained within the box.
Figure 6:
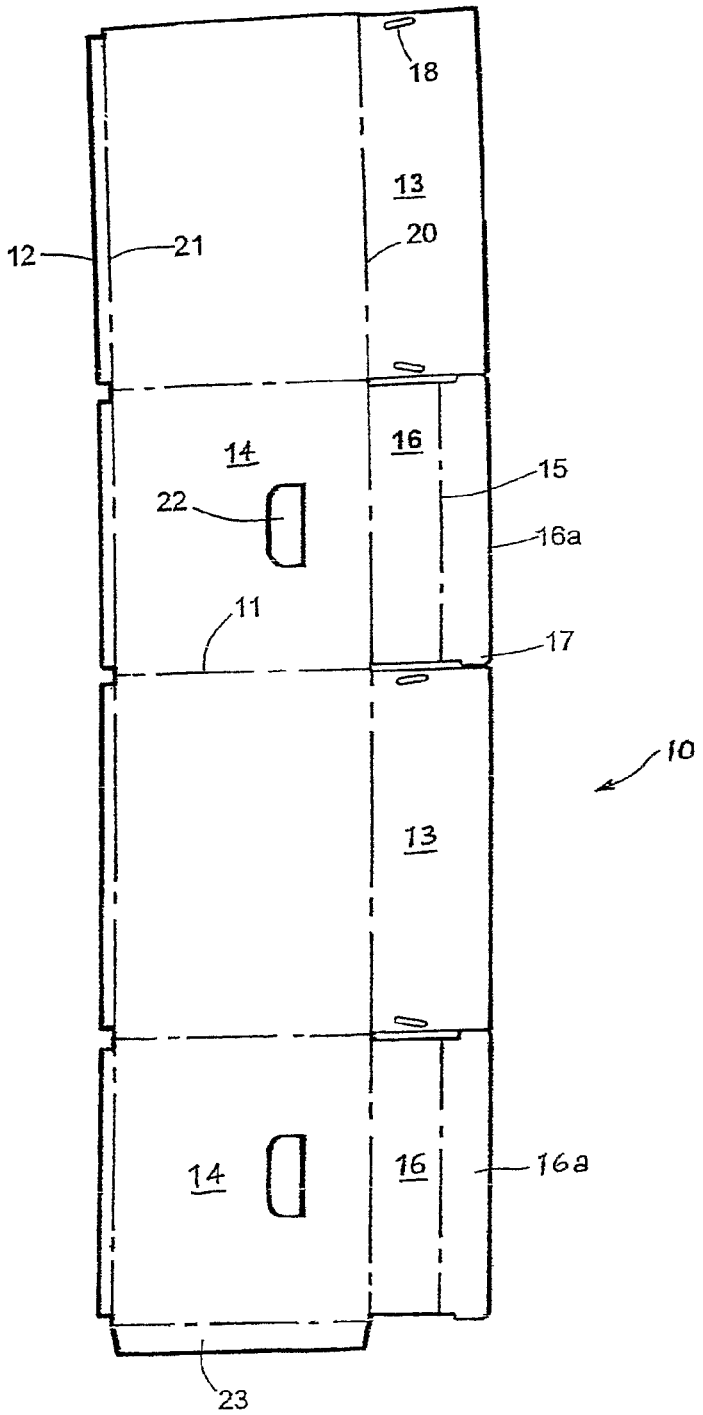
FIG. 6 is a die-cut blank preferred embodiment of the side wall panels.

FIGS. 1,2,4,5,6,7 and 8 show a first embodiment of a storage box 100 according to the present invention, which includes a substantially rigid wrapper 10 forming four articulated side wall panels. As shown in FIG. 6, the side wall panels are pre-cut as a single die-cut piece of fibreboard or other suitable material, provided with preformed folds 11, 15, 20 and 21. An end tab 23 allows the wrapper 10 to be joined at the outer ends, for example by self adhesive strips to form the rectangular box-like form shown in FIG. 1. The joining of the outer ends of the wrapper may be left to a user when the box is erected for use, or may be joined at the manufacturing stage.

Figure 1:
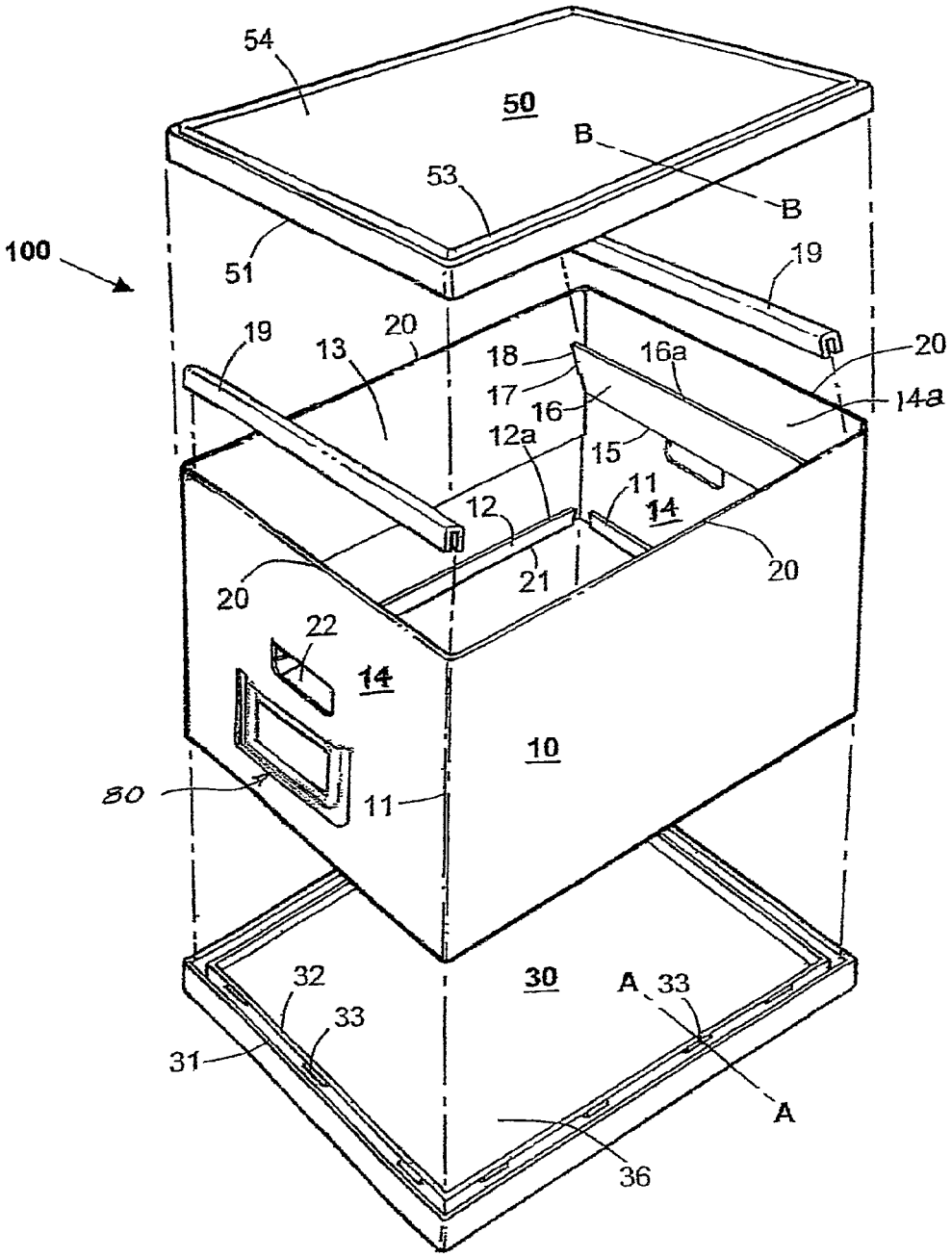
FIG. 1 is an exploded perspective view of a preferred embodiment of a storage box according to the present invention.

With reference to FIGS. 1 and 6, the upper edges 20 of the side wall panels of wrapper 10, are provided with extension portions to give a double thickness of material to the upper parts of the side wall panels when folded about fold lines at edges 20. The lower edges 21 of the side wall panels are likewise, in this embodiment of the invention, provided with lower extension portions 12, which when folded upwardly about fold lines at edges 21, provide a portion of double wall thickness along the lower periphery of the wrapper 10 as shown in FIG. 1.

Figure 2:
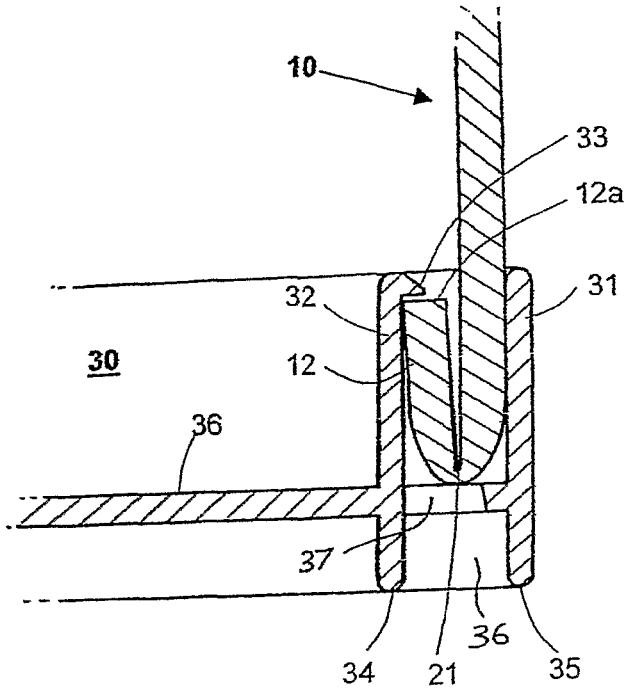
FIG. 2 is a partial Section View showing a preferred means of engaging the side wall panels of the storage box of FIG. 1 to a base portion.
Figure 3:
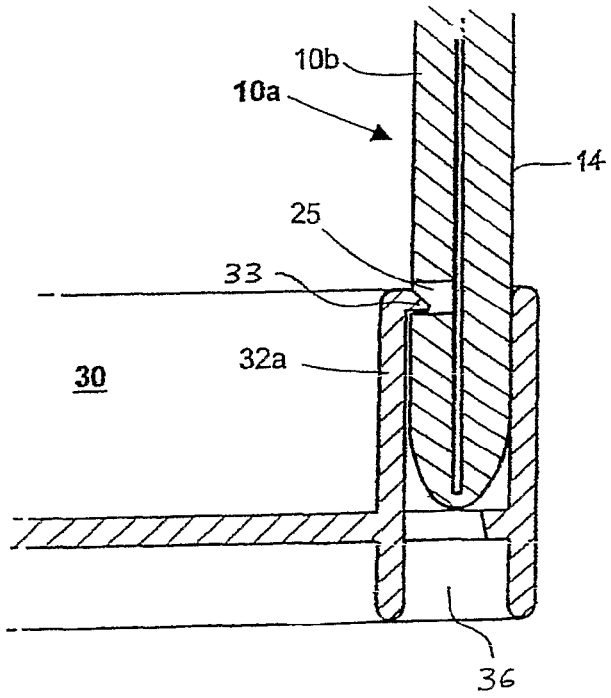
FIG. 3 is a partial section view showing a preferred means of engaging the side wall panels with the base of FIGS. 1 and 2 by use of a plurality of holes in the lower ends of the side wall panels.

A base portion 30 is preferably injection moulded from a suitable plastic. Base portion 30 is a planar rectangular panel provided at its periphery with an upwardly projecting upper channel formation 30A comprising two upstanding substantially parallel walls, outer wall 31 and inner wall 32 as best seen in FIGS. 1, 2 and 3. Walls 31 and 32 are spaced apart a little more than the double thickness of material at the lower edge of wrapper 10. Inner wall 32 is provided with inward facing short protrusions 33 spaced around the top inner edge of the inner wall 32. The depth of the upper channel formation 30A beneath each short protrusion 33 is substantially equal with the height of the short extension portions 12 at the lower edges 21 of the wrapper 10.

The lower portions of the side wall panels and folded over extension portions 12 are forced between opposing outer walls 31 and inner walls 32 of base 30 and past the front faces of the short protrusions 33. When folded edge 21 is seated at the bottom of the channel formation 30A, the resiliently biased folded over portions 12 spring open a little so that the top edges 12*a* of the short return folds 12 become locked beneath the short inward facing protrusions 33 to lock the wrapper 10 to the base 30.

Preferably, as shown in FIG. 2, the base portion of the channel formation 30A between outer wall 31 and inner wall 32 is provided with slots 37. These allow the insertion of a suitable implement to force folded over portions 12 back against the inside surfaces of the side wall panels of the wrapper 10. By this means the upper edges 12*a* may be released from engagement with protrusions 33 allowing an assembled box to be disassembled and returned to a flat pack state for compact storage and later re-use. In addition to providing a means of disassembly of the side wall panels from the base portion, the aperture 37 also permit simplified tooling for injection moulding.

Opposing upper extension portions 13 of the longer opposing side walls and upper extension portions 16 of the shorter opposing end walls 14, are arranged to interfere at their meeting edges when folded downward so as to maintain their position. The upper extension portion 16 of the two opposing end side walls 14, are provided with a transverse crease 15, to allow the lower portions of flaps 16 to be folded upward, if the storage box 100 is to be used for storing files in file hangers. When these lower portions are in this upward folded position, the upper edges 16*a* are located sufficiently below the level of top edge 20 of the side walls to allow for the depth of hang file rails as shown in FIG. 5 and hang file labels or tags (not shown) which project above the rail.

To secure the lower portions of extension portions 16 in the correct position (as shown in FIGS. 1 and 5) to accept the notched ends 71 of hanging files 70, tabs 17 provided at the outer ends of the extension portions engage with corresponding holes 18 in the adjacent side extension portions 13. When tabs 17 of extension portions 16 are assembled to holes 18, the edges 16*a* at opposing end walls 14 are so separated as to suit the length and depth of standard hanging files 70.

As best seen in FIG. 5, top edges 16*a* are preferably capped with a length of plastic channel section 19 to protect the edges 16*a* and add beam strength so as to better support the notched ends 71 of file hangers 70 and the weight of files.

For storage purposes other than that of files in hangers, lower portions 16 are folded back into contact with the upper section of flap 14*a*, and are retained in this un-obstructing position by the engagement of tabs 17 in notches (not shown) in the ends of the side flaps 13.

The opposing end walls 14 are provided with hand holes 22 to allow lifting of the storage box. Bottom folds 15 of flaps 14*a* are coincident with the top edges of hand holes 22 such that three material thicknesses are grasped when lifting the box 100.

The Storage box 100 of this first preferred embodiment of the invention is provided with a lid 50, injection moulded from a suitable plastic. Lid 50 comprises a substantially planar panel provided at its periphery with a downwardly projecting channel 36 comprising an inner wall 51 and outer wall 52. Walls 51 and 52 are so spaced apart that the channel formation may be placed over folded over upper edges 20 of the side wall panels of the wrapper 10, as shown in FIGS. 4 and 5. The lid 50 functions firstly to close the top of the box and secondly to prevent the side walls from bowing in or out, thereby adding significantly to the integrity of the box when supporting the weight of superior boxes in a stack of boxes.

The base 30 and lid 50 are provided with mating elements, peripheral downwardly projecting lower channel 36 and peripheral upwardly projecting ridge 53 respectively, as best seen in FIG. 4. These mating elements allow one box to be accurately and securely stacked one above another when ridge 53 is located in channel 36.

In this first preferred form, the components of storage box 100 are provided to the consumer in flat pack form, for assembly by the consumer.

Second Preferred Embodiment

Figure 7:
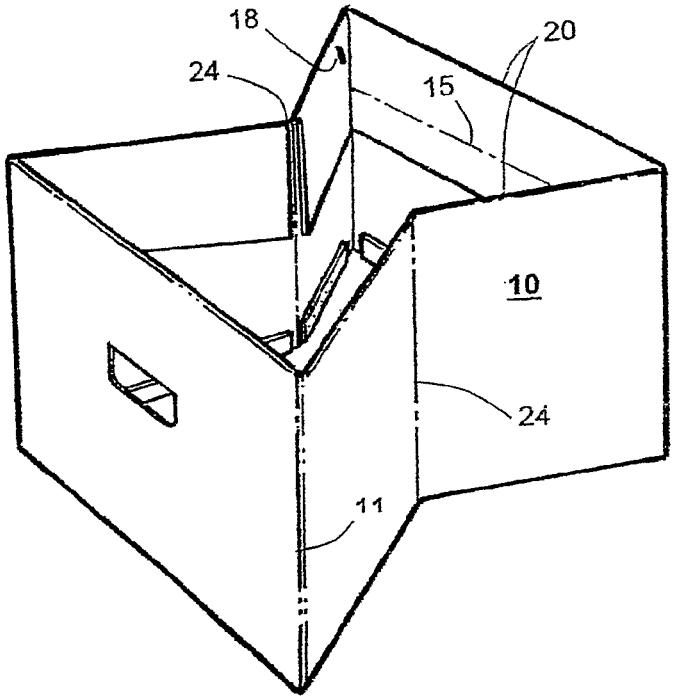
FIG. 7 shows a perspective view of a preferred form of the articulated side wall panels provided with additional centre folds so as to allow the panels to fold into a shorter length.
Figure 8:
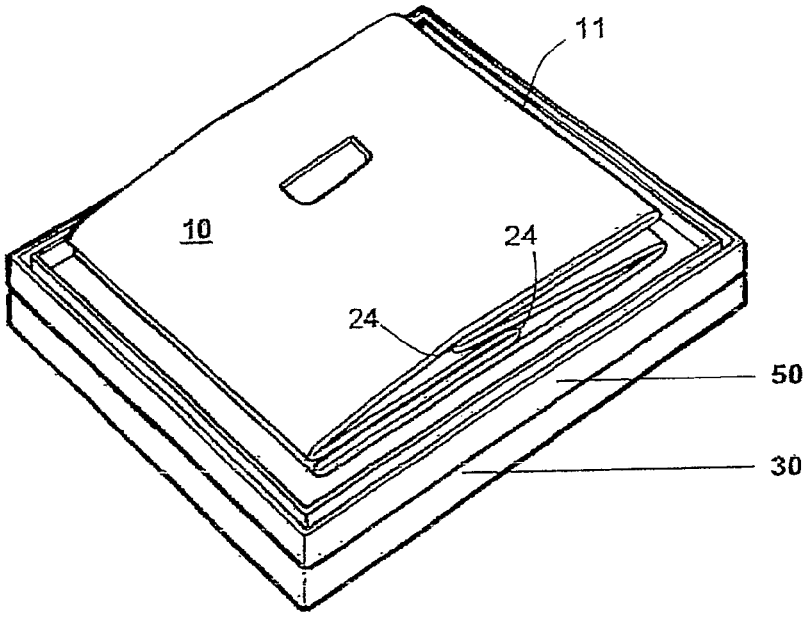
FIG. 8 shows a perspective view of the side wall panels of FIG. 7 folded down flat within the periphery of a lid, with the lid nested with the base.

In a second fore of the invention shown in FIGS. 7 and 8, the wrapper 10 has an additional fold line 24 down the centre of the two opposite longer side walls. Folds 24 allow the wrapper 10 to be folded into a shorter pack and nested within the periphery of the inverted lid 50. As can be seen in FIG. 8, inverted lid 50 may in turn be nested within the inverted base 30 to provide a compact flat assembly which may be packaged for example by shrink wrapping for point of sale.

Third Preferred Embodiment

With reference to FIG. 3, in a further preferred form of the invention, attachment of the wrapper 10 with the plastic base 30 is effected by punched holes 25 provided in extended folded portions 10*b* engaging with the afore described protrusions 33. Although FIG. 3 shows the punched holes 25 in the upturned portions 10*b*, holes 25 could alternatively be formed in end wall panel 14, Retaining protrusions 33 would then be located at the inner edges of the outer wall 31 of the base 30.

Fourth Preferred Embodiment

In yet a further preferred form of the invention, the wrapper 10 may be formed from a creasable and foldable plastic material. The plastic material is provided with punched holes adjacent lower edges 21 to engage with a number of corresponding protrusions at the inner or outer walls 32 and 31 as described above. In this embodiment, the side wall panels of the wrapper 10 need not be provided with folded over portions 12, so that a single thickness of the panel material is retained in a narrower channel formation between the inner and outer walls.

Fifth Preferred Embodiment

In yet another form of the invention the wrapper 10 may be formed from a plastic material suitable for injection moulded integral hinges, and provided with saw-tooth like protrusions along the lower edges 21 for snap-lock engagement with the channel formations of base moulding 30.

Sixth Preferred Embodiment

Figure 9:
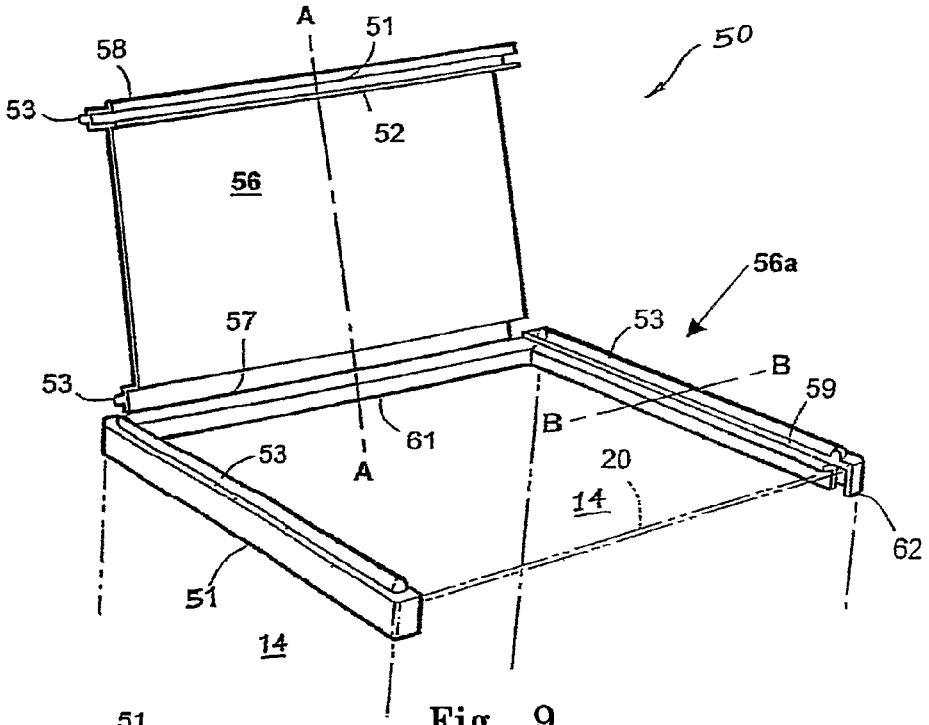
FIG. 9 shows a perspective view of another preferred embodiment of a lid for the storage box of FIGS. 1 to 8 wherein a planar portion of the lid is hingedly attached to a part of a lid frame.
Figure 10:
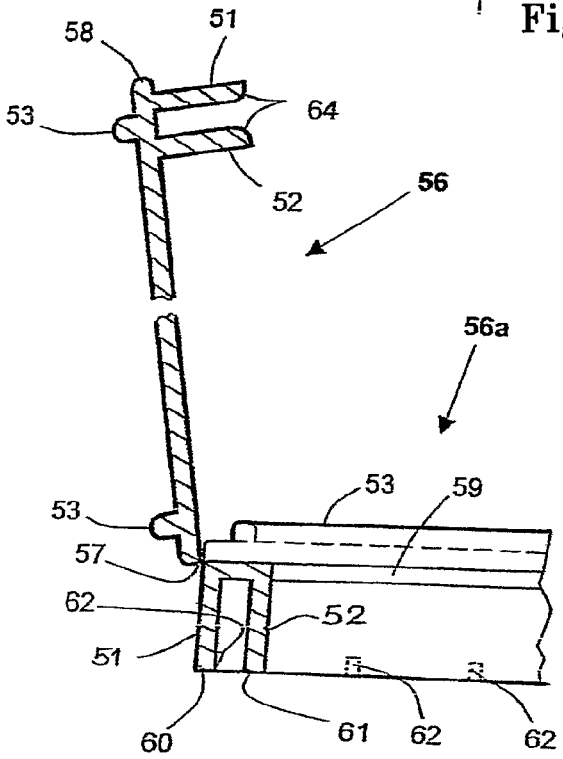
FIG. 10 and 10A show partial section views of the lid of FIG. 9 along the lines A-A and B-B respectively.
Figure 10A:
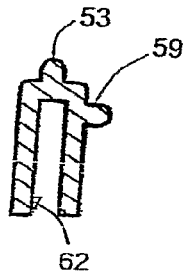

With reference to FIGS. 9, 10 and 10*a*, the lid 50 comprises a planar portion 56 and peripheral channel formations as described above engaging with the upper edges 20 of three of the side wall panels of wrapper 10, that is along one longer side panel and along the opposing end wall panels 14. At least one of the inner edges of the inner and outer walls forming the peripheral channel formation, is provided with retention lugs 62 projecting into the channel formation. Lugs 62 are preferably tooth-shaped so as to initially allow insertion of the upper folded over edges 20 but subsequently grip the material of the panels.

In this embodiment planar portion 56 is attached by an integral hinge 57 along the outer upper edge of outer wall 51 of channel formation 61 along the longer side wall. Integral with planar portion 56 is the length of channel formation 64 opposite hinge 57. The length of channel formation 64 is provided with an extending lip 58 as a gripping ledge for opening lid 50.

Seventh Preferred Embodiment

Figure 11:
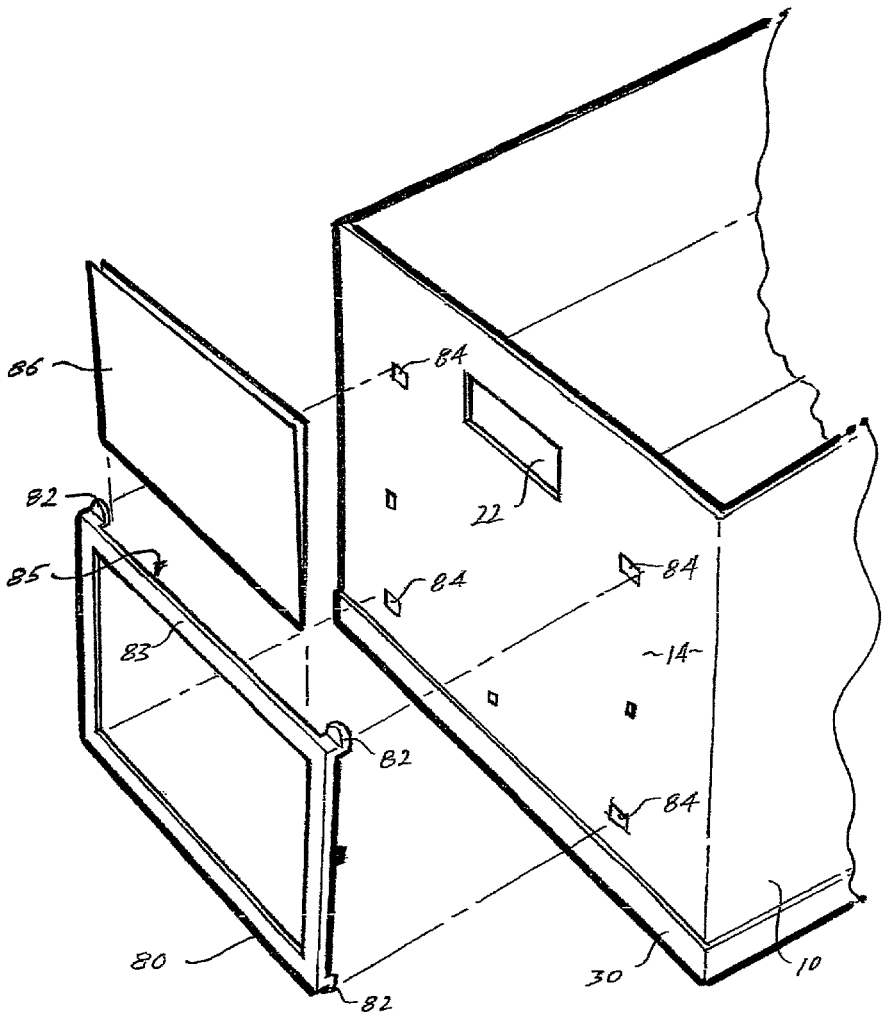
FIG. 11 is a partial perspective view of one end of the storage box of FIG. 1 showing a preferred form of a label holder and label.
Figure 12:
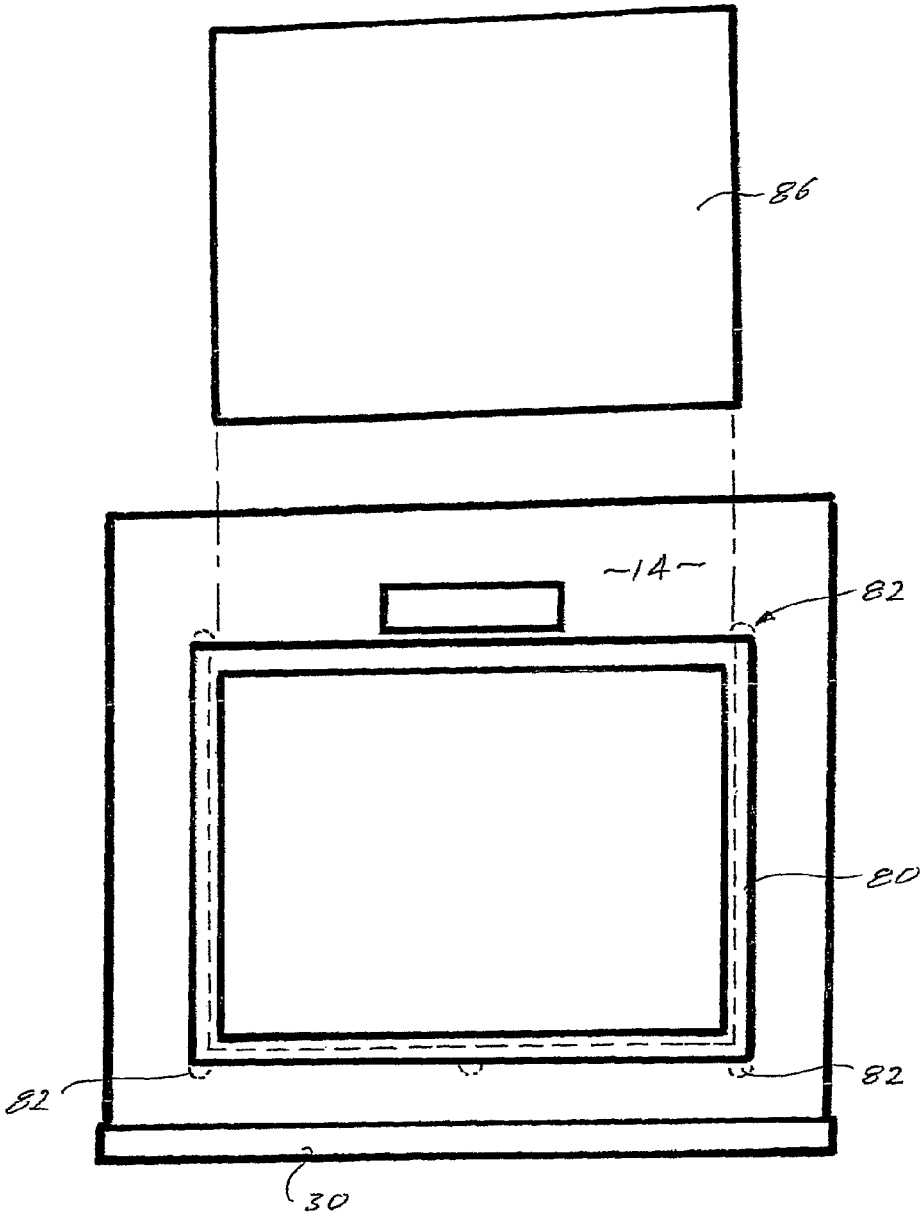
FIG. 12 is an end elevation view of the end of the storage box of FIG. 11 with a label holder attached to the box and a label inserted in the holder.

The storage box of any one of the above described embodiments, may be provided with a label holder 80 as shown in FIGS. 1, 11 and 12 for attachment to one side wall panel, preferably a shorter end side wall panel 14, for insertion therein of a label identifying the contents and other data relative to the storage box. The holder 80 may be of injection moulded plastic and provided, at least at the four corners of the holder, with suitable lugs 82 for insertion into corresponding pre-punched holes in the material of the wrapper 10. The method of assembly is best seen in the sectioned views of FIGS. 13 and 14.

Figure 13:
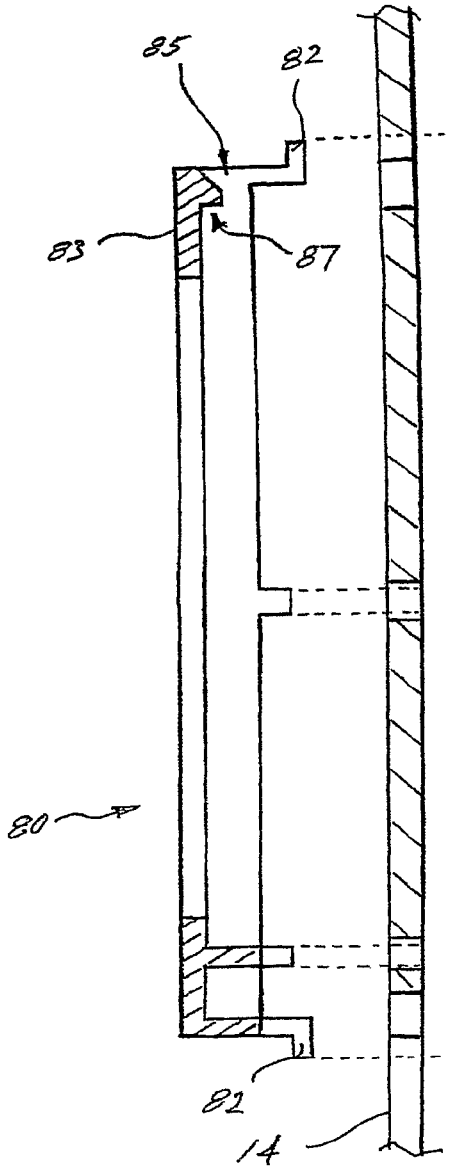
FIGS. 13 and 14 are sectioned views of the label holder of FIGS. 11 and 12.
Figure 14:
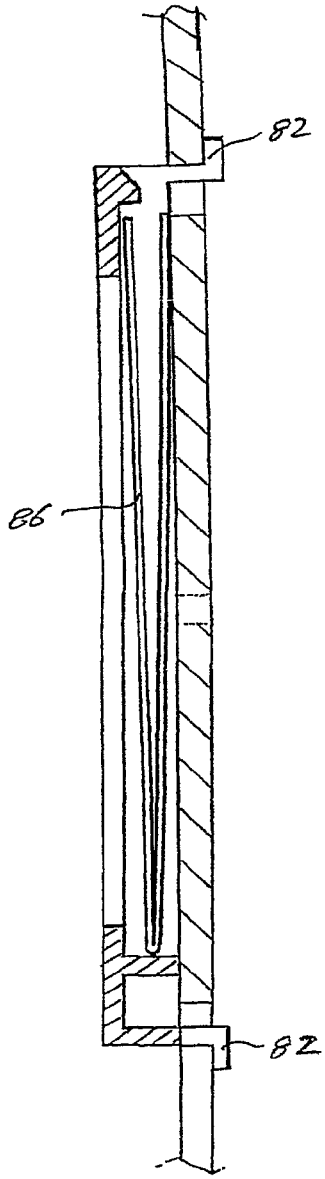

As also best seen in FIGS. 13 and 14, the upper cross member 83 of holder 80 is formed with a cut-out portion 85 so that when assembled to the surface of end side wall panel 14, cut out portion 85 provides a slot for the insertion of a label therethrough.

In a particular preferred form of the label holder 80 shown in FIGS. 11 and 12, the holder is sized to accept a to half folded over sheet of a standard sized paper. Thus for example, for storage boxes for use in the United States, the label holder 80 would be sized to suit letter sized paper, while for Europe and other metric countries, the holder would accept a folded sheet of A4. Once inserted, the label is retained by the outer edged of the folded sheet catching under an internal projecting lip 87 provided at upper cross member 83.

In Use

The components comprising the storage box as herein above described are preferably provided as a flat pack package for erection as required by a user. After removal of the components, the wrapper is arranged to form the four-side box structure and the upper and lower extension portions folded as described. The lower, now folded edges of the wrapper, are then pushed into the channel of the base portion. If the box is to be used for hang files, the end wall extension portions are folded into the correct position and fitted with the lengths of channel sections. Finally the lid is fitted over the upper folded edges of the four side walls.

It will be appreciated that the combination of the double thicknesses of the upper and lower edges of the four walls when engaged with the respective peripheral channels of the base portion and the lid portion, provide a much stronger box than that of a conventional fibreboard storage box. The peripheral channel of the lid in particular prevents the bowing out or in of the upper edges of the box, thus allowing a box to support a far greater stack of superior boxes.

Should a once erected box not be required for some length of time, the structure is readily dismantled back to a flat pack configuration for compact storage against future use.

The above describes only some embodiments of the present invention and modifications, obvious to those skilled in the art, can be made thereto without departing from the scope and spirit of the present invention. Thus for example, the wrapper making up the four side wall portions need not be formed of one piece of material but could be supplied as two or even four separate sections provided with suitable tabs at the outer vertical edges for assembly into the opposing side walls and end walls of the box structure.

Figure 15:
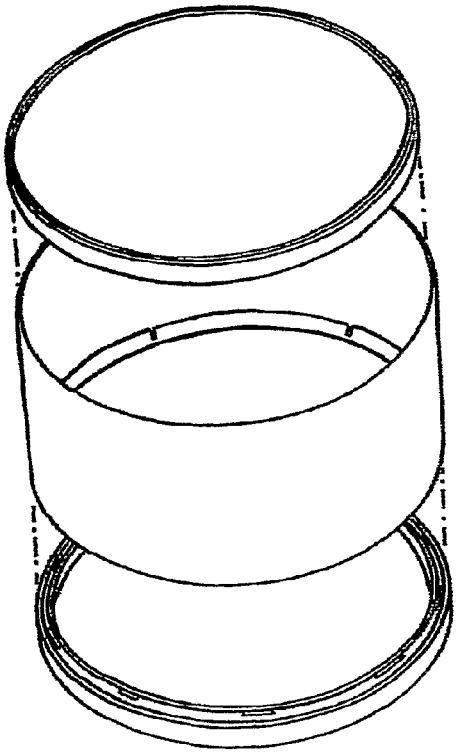
FIG. 15 is a perspective view of a storage box of substantially circular wall configuration according to a further preferred embodiment and FIG. 16 is a perspective view of a storage box of substantially triangular wall configuration according to yet a further preferred embodiment.
Figure 16:
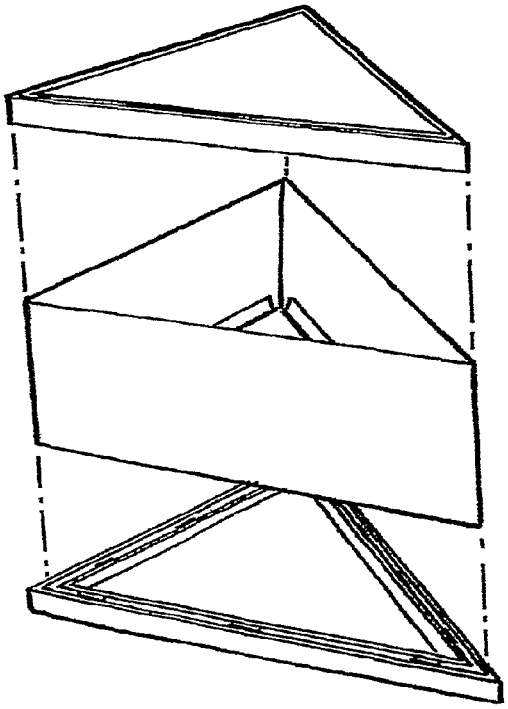

Further modifications envisaged in the present invention include storage boxes of a variety of shapes including circular, triangular (refer FIGS. 15 and 16) and various regular and irregular polygons. Shapes may also include combinations of arcuate and straight sides to suit particular shapes of articles to be stored. Regardless of the number and configuration of the side walls, the method of engagement of the walls with a suitably shaped base portion remains as described for the four sided embodiment above.

What is claimed is:

1. A storage box assembly, comprising:

at least one wall panel having a lower extension portion that is adapted to be upwardly folded and resiliently biased to return to an unfolded configuration;

a base element having an upper peripheral channel on a top side thereof defined by a substantially rigid inner channel wall and a substantially rigid outer channel wall; and at least one protrusion disposed on an inner surface of at least one of the channel walls, wherein, when the lower extension portion of the at least one wall panel is inserted into the upper peripheral channel of the base element with the lower extension portion upwardly folded, the at least one wall panel becomes locked to the base element with at least part of the lower extension portion retained within the upper peripheral channel below the at least one protrusion, thereby forming a storage box.

2. The storage box assembly of claim 1, wherein the substantially rigid inner channel wall and the substantially rigid outer channel wall are continuous about a periphery of the base element.

3. The storage box assembly of claim 1, wherein the upper peripheral channel has a predetermined shape, such that, when the at least one wall panel is locked to the base element, the at least one wall panel assumes the predetermined shape.

4. The storage box assembly of claim 1, wherein the base element further comprises a lower peripheral channel on a bottom side thereof.

5. The storage box assembly of claim 4, further comprising a substantially planar lid element having a downwardly facing peripheral channel on a bottom side thereof and an upwardly extending peripheral ridge on a top side thereof, the peripheral ridge being substantially opposite and coincident to the downwardly facing peripheral channel, wherein the upwardly facing peripheral ridge is configured to be received within the lower peripheral channel of the base element for stacking in releasable vertical alignment.

6. The storage box assembly of claim 1, wherein the at least one wall panel comprises:

a first side wall panel and an opposing second side wall panel; and a first end wall panel and an opposing second end wall panel, wherein the first and second side wall panels alternate with and are joined to the first and second end wall panels via preformed fold lines to form a wrapper, and wherein each of the end wall panels includes an upper extension portion adapted to be downwardly folded to increase a thickness of at least a portion of each of the end wall panels.

7. The storage box assembly of claim 1, further comprising a label holder comprising:

an upper cross member;

a lower cross member;

a pair of side members joining the upper cross member to the lower cross member; and at least two projecting lugs, wherein the at least one wall panel includes at least two holes adapted to receive the projecting lugs when the label holder is bowed for insertion of the lugs through the holes and whereafter it straightens to capture the lugs within the holes, thereby securing the label holder to the at least one wall panel with sufficient space to slidably and releasably receive a label between a rear face of the label holder and an outer face of the at least one wall panel.

8. The storage box assembly of claim 7, wherein the label holder is dimensioned to accommodate a sheet of standard-sized paper folded parallel to its shorter edge when the label holder is secured to the at least one wall panel.

9. The storage box assembly of claim 6, wherein each of the upper extension portions includes a transverse crease that enables a lower portion of the upper extension portion to be folded upwardly and secured with an edge of the lower portion below an upper edge of the end wall panel in order to provide a supporting edge for at least one hanging file.

10. The storage box assembly of claim 9, further comprising at least one length of rigid channel section adapted to fit over at least a portion of the edge of the lower portion of the upper extension portion, thereby protecting the edge of the lower portion of the upper extension portion and providing a hanging file rail.

11. The storage box assembly of claim 5, wherein the at least one wall panel includes at least one crease enabling the at least one wall section to be folded flat, and wherein the storage box assembly is provided with the flattened at least one wall section, the base element, and the lid element arranged as a compact flat assembly.

12. The storage box assembly of claim 5, wherein the lid element comprises:

a frame portion; and a lid panel hingedly attached to the frame portion, and wherein the downwardly facing peripheral channel of the lid includes a plurality of retention lugs adapted to secure the lid element to the at least one wall panel.

13. The storage box assembly of claim 5, wherein the downwardly facing peripheral channel on the bottom side of the lid element comprises a substantially rigid material, thereby to enhance structural integrity of the storage box and to maintain the at least one wall panel in a substantially planar configuration.

14. The storage box assembly of claim 1, wherein the at least one wall panel includes an upper extension portion joined to the at least one wall panel via a fold crease that permits the upper extension portion to be folded downwardly inside a perimeter of the at least one wall panel, such that, when the at least one wall panel is locked to the base element, the downwardly folded upper extension portion increases a wall thickness of at least a portion of the at least one wall panel.

15. The storage box assembly of claim 1, wherein the base element comprises a substantially rigid plastic material.

16. The storage box assembly of claim 5, wherein the lid element comprises a substantially rigid plastic material.

17. The storage box assembly of claim 1, wherein, when the lower extension portion of the at least one wall panel is upwardly folded and inserted into the upper peripheral channel of the base element, the lower extension portion terminates above a top edge of the channel walls, and wherein the lower extension portion of the at least one wall panel comprises a plurality of holes adapted to engage the at least one substantially rigid protrusion when the lower extension portion of the at least one wall panel is inserted into the upper peripheral channel of the base element.

18. The storage box assembly of claim 1, wherein the at least one wall panel comprises a material capable of supporting a crease and capable of being folded over upon itself.

19. A method of assembling a storage box, comprising the steps of:

providing at least one wall panel having a lower extension portion that is adapted to be upwardly folded and resiliently biased to return to an unfolded configuration;

providing a base having a peripheral channel defined by a pair of substantially rigid opposing walls, the peripheral channel including at least one substantially rigid protrusion disposed on an inner surface of at least one of the pair of substantially rigid opposing walls; and inserting the at least one wall panel into the peripheral channel of the base with the lower extension portion upwardly folded such that the at least one wall panel becomes locked to the base with at least a portion of the lower extension portion below the at least one substantially rigid protrusion.

20. The method of claim 19, wherein the at least one wall panel further comprises an upper extension portion including a first extension portion and a second extension portion, and further comprising the steps of:

folding the first extension portion downward to form an upper edge to the at least one wall panel; and folding the second extension portion upward to form a lower edge and a supporting edge parallel to and below the upper edge of the at least one wall panel.

21. The method of claim 20, further comprising the steps of:

fitting a length of channel section to the supporting edge; and fitting a lid to the folded upper extension portion of the at least one wall panel.

22. The storage box assembly of claim 1, wherein the base element further comprises at least one slot in a base portion thereof, wherein the at least one slot is aligned substantially opposite the at least one protrusion.

* * * * *